United States Patent [19]

Barbe

[11] 4,440,190

[45] Apr. 3, 1984

[54] CONTROL MECHANISM FOR A FIRE HYDRANT

[75] Inventor: Pierre L. Barbe, Toul, France

[73] Assignee: Pont-a-Mousson S.A., Nancy, France

[21] Appl. No.: 347,208

[22] Filed: Feb. 9, 1982

[30] Foreign Application Priority Data

Feb. 12, 1981 [FR] France ..... 81 02948

[51] Int. Cl.[3] ..... E03B 9/02

[52] U.S. Cl. ..... 137/272; 137/315

[58] Field of Search ..... 137/272, 283, 284, 315

[56] References Cited

U.S. PATENT DOCUMENTS 2,836,190 5/1958 Elsey ..... 137/315

FOREIGN PATENT DOCUMENTS 938855 12/1973 Canada ..... 137/272
606008 3/1932 Fed. Rep. of Germany ..... 137/272
332911 12/1935 Italy ..... 137/272

*Primary Examiner*—George L. Walton
*Attorney, Agent, or Firm*—Sughrue, Mion, Zinn, Macpeak, and Seas

[57] ABSTRACT

The control mechanism to which the invention relates is intended to equip fire hydrants of the type comprising an outer body (1) extended downwards by an underground elongated pipe (2) connecting it to a water supply pipe (3), a valve cooperating with a valve seat, a control member (21) opening out at the upper end of the outer body (1) and said mechanism. The latter is constituted by a control rod (19) integral with a support member (7 ) constituted by a central sleeve (14) connected by radial arms (15) to a circular rim (16) provided with cylindrical bosses (17) and at least one lug (18) engaging in corresponding housings (11–13) provided in a support holder (6) fixed to the upper end of the elongated pipe (2).

Application to fire hydrants.

7 Claims, 5 Drawing Figures

CONTROL MECHANISM FOR A FIRE HYDRANT

The present invention relates to a control mechanism for a fire hydrant of the type comprising an outer body extended downwards by an underground elongated pipe connecting it to a water supply pipe, a valve cooperating with a valve seat, said mechanism, located at the upper end of the elongated pipe and ensuring the translation of the valve with respect to its seat and a control member opening out at the upper end of the outer body.

This type of fire hydrant in two parts is constructed, in known manner, in order that under the effect of an impact involving the outer body, only the latter and the control member which it contains are damaged, the underground part remaining intact, which eliminates any risk of water leakages or losses. In order to achieve this remarkable property, it is necessary that the control mechanism ensuring the translation of the valve with respect to its seat is located in the underground part of the fire hydrant. Generally speaking, the control mechanism is located at the upper end of the underground elongated pipe and is constituted by an operating rod integral with a support fixed to the elongated pipe. The upper end of the operating rod is connected by a non-rotary connection to the lower end of a tubular control member located inside and over the entire height of the outer member. The lower end of the operating rod is connected by a connection of the screw/nut type to the upper end of a tubular member located inside and over the entire height of the underground elongated pipe and terminating in a closure member.

Known control mechanisms are fixed to the upper end of the underground elongated pipe either by bolt-/nut systems, or by a system constituted by a resilient ring located in a groove. In the first case, the bolts and nuts quickly become rusted, which makes them difficult to dismantle when carrying out a maintenance inspection of the fire hydrants. In the second case, since the full hydrostatic thrust of the water on the closure member is taken by the ring housed in its groove, it is necessary that the latter is not impaired by corrosion and should thus be made from stainless steel, which constitutes an expensive solution.

The invention intends to remedy these drawbacks by providing a control mechanism which is easy to fit and dismantle for a fire hydrant of the above-described type.

To this end, the invention relates to a control mechanism of the aforesaid type comprising a control rod integral with a support member constituted by a central sleeve, connected by radial arms to a circular rim, characterised in that said rim comprises, cast in one piece therewith, two diametrically opposed cylindrical bosses and at least one lug engaging in corresponding housings provided in a part fixed to the upper end of the elongated pipe.

Further features and advantages of the invention will become apparent on reading the ensuing description referring to the accompanying drawings given solely as non-limiting examples and in which.

Figure 1:
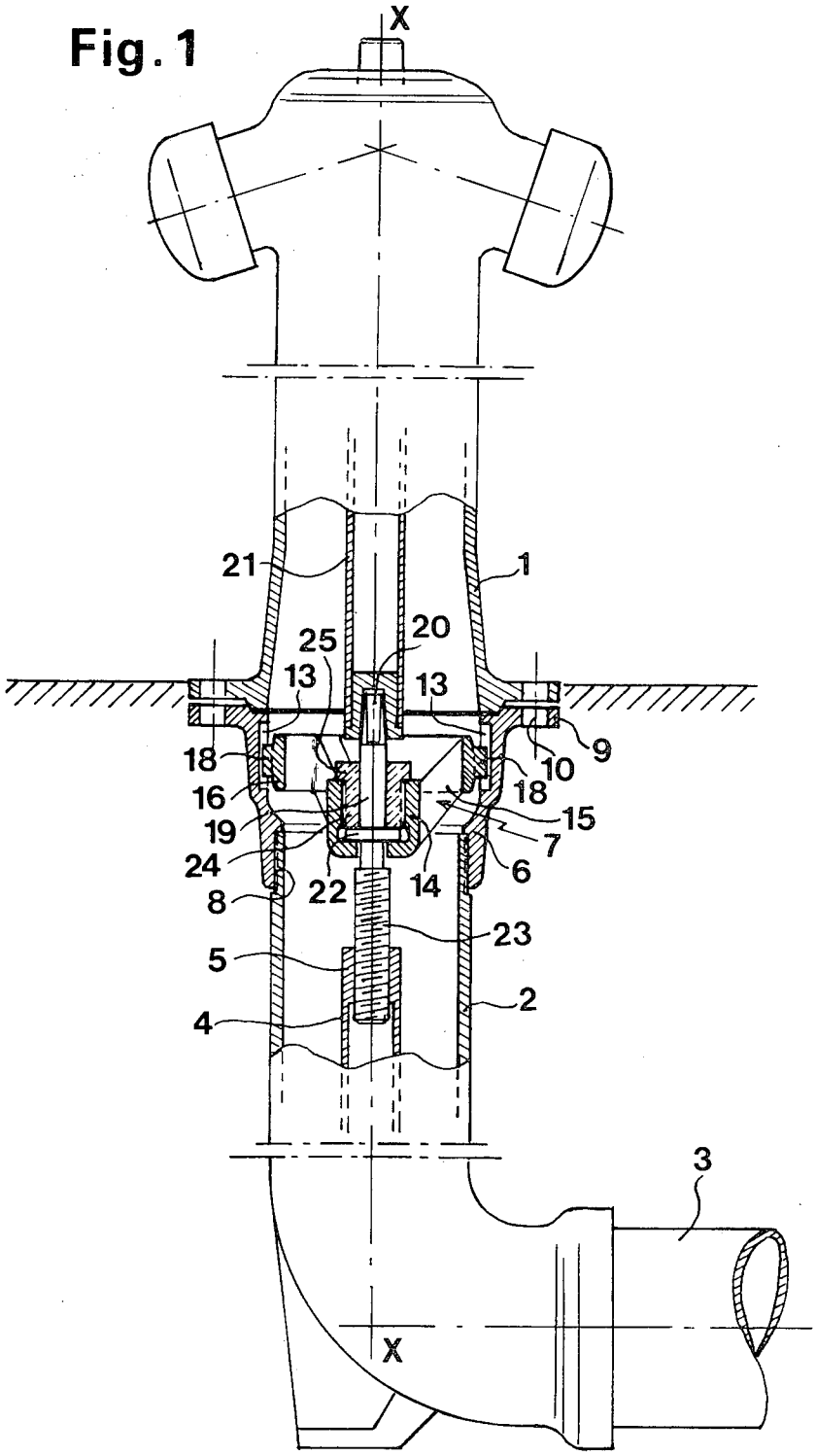
FIG. 1 is an elevational view with partial axial section of a fire hydrant comprising a control mechanism according to the invention.
Figure 3:
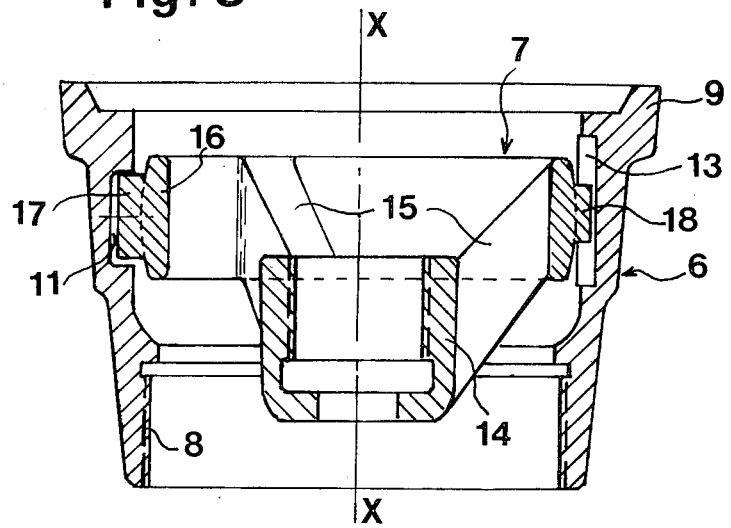
FIG. 3 is a sectional view on line 3—3 of FIG. 2.
Figure 2:
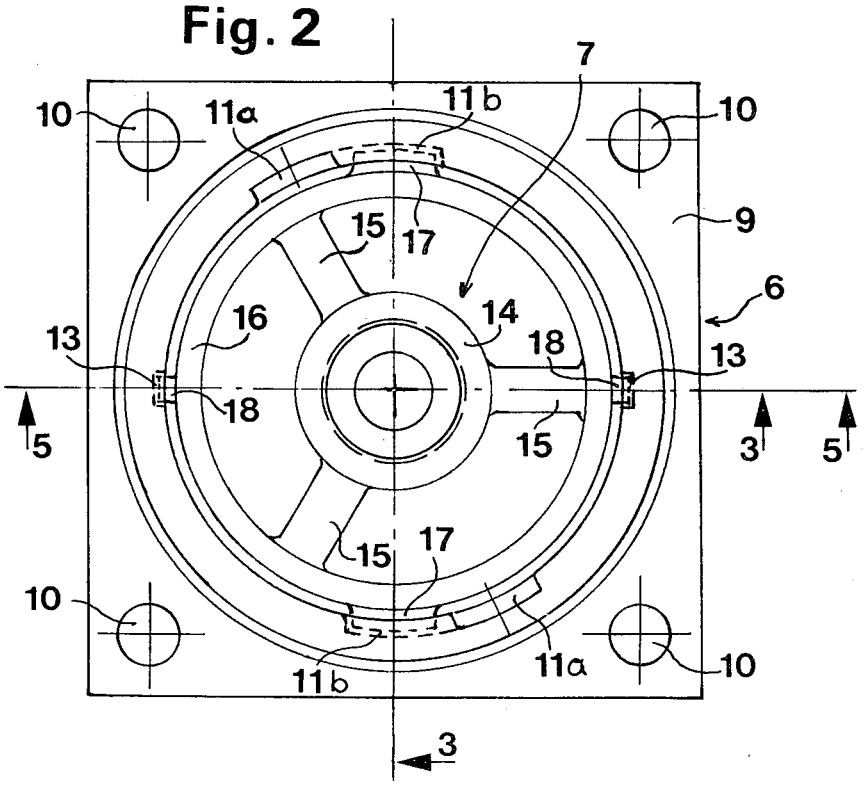
FIG. 2 is a plan view of the control mechanism according to the invention.

The fire hydrant on the vertical axis XX provided with a control mechanism to which the invention relates (cf FIG. 1) comprises an outer body 1 extended downwards by an underground elongated pipe 2 connecting it to a water supply pipe 3 and a closure member cooperating with a seat (not shown) making it possible to isolate the fire hydrant from the water supply pipe 3. The valve is provided with means which prevent it from rotating with respect to its seat and it is fixed to the lower end of a tubular member 4 whereof the upper end is provided with a lock nut 5.

The upper end of the elongated pipe 2 supports a part 6, connected by screwing, serving on the one hand for connecting the outer body 1 to the elongated pipe 2 and on the other hand for keeping in place a support 7 for the control mechanism. The support holder 6 which is in the general shape of a cylindrical socket on a vertical axis X—X comprises at its lower end and over a certain height, an internal screwthread 8 making it possible to connect it by screwing to the upper end of the underground elongated pipe 2. The support holder 6 terminates at its upper end in a square flange 9 pierced with holes 10 for the passage of bolts connecting the outer body 1 and the elongated pipe 2. Provided in the wall of the part 6, opening out on the inside, are two diametrically opposed L-shaped housings 11, whereof the vertical side **11*a* opens out at the upper end of the part 6 and whereof the end of the horizontal side 11*b* terminates in a half-cylinder 12 and two diametrically opposed housings 13, in the form of a groove, parallel to the axis X—X. The diameters passing respectively through the centres of the half-cylinders 12 terminating the housings 11 and through the housings 13** are perpendicular.

The control mechanism to which the invention relates is composed of two parts: a support member 7 and a control rod 19 for the closure member. The support member 7 is constituted by a central sleeve 14 screwthreaded internally and connected by three inclined radial arms 15 to a circular rim 16 comprising, cast in one piece therewith, two diametrically opposed cylindrical bosses 17 and two lugs 18 which are themselves also diametrically opposed. The diameters passing respectively through the bosses 17 and through the lugs 18 are perpendicular. The bosses 17 are intended to be engaged in L-shaped housings 11 in the support holder 6, whereas the lugs 18 are provided in order to cooperate with the housings 13 in the form of grooves.

The operating rod 19 of the valve terminates at its upper end in a square 20 engaging a tubular member 21 opening out at the upper end of the body 1. In its central part, the rod 19 comprises a flange 22 resting on the bottom of the socket 14 and a lower screwthreaded part 23 engaged in the nut 5 of the tubular member 4 connected at its lower end to the valve. A bearing support 24, terminated at its upper end by a hexagonal nut 25, keeps the rod 19 in position in the socket 14.

Figure 4:
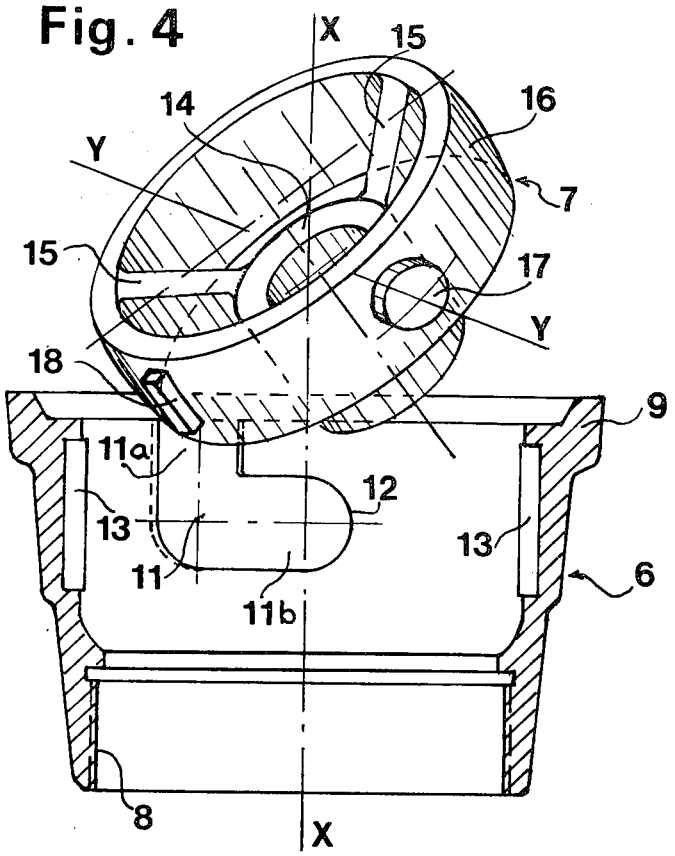
FIG. 4 is a perspective view of the support member for the control rod when fitting it in the support holder fixed to the upper end of the underground elongated pipe.
Figure 5:
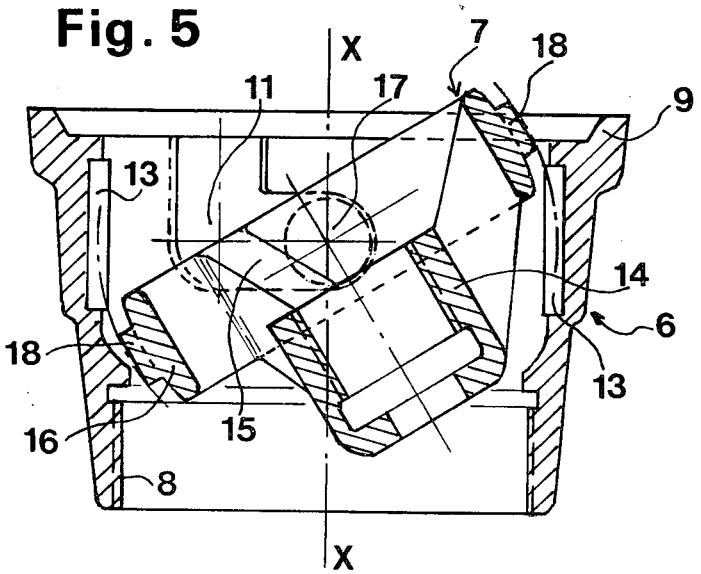
FIG. 5 is a sectional view on line 5—5 of FIG. 2 showing the final stage of fitting the support for the control rod in the part fixed to the upper end of the underground elongated pipe.

The assembly of the control mechanism will now be described:

after having fitted the elongated pipe 2 provided with the support holder 6 and equipped with its seat, its valve and the tubular member 4 on the pipe 3 and before fitting of the outer body 1, the support member 7 for the control mechanism is tilted about the axis Y—Y passing through the centres of the bosses 17 as shown in FIG. 4 and lowered parallel to the axis X—X in the support holder 6 by engaging the bosses 17 in the vertical part 11*a* of the housings 11, then subjected to a rotary movement in clockwise direction about the axis X—X until the bosses 17 are in contact with the half-cylinders 12 constituting the end of the horizontal sides 11*b* of the housings 11. This support member 7 is then returned to the horizontal position by rotation about the axis Y—Y, the lugs 18 fitting in the housings 13 in the form of a vertical groove, which has the effect of preventing any rotary movement about the vertical axis X—X.

Then, the rod 19 is positioned in the socket 14, its lower screwthreaded end 23 being screwed into the lock nut 5 of the tubular member 4 until the flange 22 comes to bear against the bottom of the socket 14. Finally, the bearing-support member 24 connecting the rod 19 to the support 7 is fitted by screwing, this rod 19 preventing any rotary movement of the support 7 about the horizontal axis Y—Y.

Thus, the control mechanism constituted by the support member 7 and the rod 19 is completely locked in the part 6, constituting the upper end of the underground elongated pipe 2.

The invention has a certain number of advantages and in particular as follows:

The control mechanism is very easy to fit, since it is sufficient to carry out two rotary movements in succession, the first about the vertical axis X—X, the second about the horizontal axis Y—Y, then to fit the operating rod.

The hydrostatic thrust of the water on the closure member, when the latter is in the closed position, is taken up by two cylindrical bosses 17 of some width.

Dismantling of the operating mechanism for the purpose of maintenance of the valve will always be easy, since it does not comprise any bolts and nuts which are able to corrode and may thus become rusted very easily.

As a variation, the support holder 6 may be connected to the underground elongated pipe either by separate fasteners which stick the two parts together, or by thermal binding.

Another variation consists of providing the rim 16 with a single lug 18 and the support holder 6 with a single housing 13 in order to receive it.

I claim:

1. A control mechanism for a fire hydrant having an upper outer body (1) connected to a lower elongated pipe (2) containing a valve translationally engaging a valve seat, comprising:

a control rod (19) controlling the translation of said valve and extending above said elongated pipe;

a support holder (6) fixed on a lower end to the upper end of said elongated pipe, said support having housings (11–13) formed in its interior surface between its upper and lower ends, at least one housing being a vertical housing parallel to the vertical axis (X—X) of the fire hydrant; and a support member (7) comprising a central sleeve (14) engagable with said control rod, radial arms (15) extending outward from said sleeve, and a one-piece cast circular rim (16) further comprising on its outer circumferential surface at least one lug (18) engaging one of said vertical housings and two cylindrical diametrically opposed bosses (17) engaging two of said housings on a horizontal axis (Y—Y) for rotating said support member about said horizontal axis during installation, said lugs and bosses upon installation locking said support member to said support holder, thereby preventing the expulsion of said valve.

2. Control mechanism for a fire hydrant according to claim 1, wherein the housings (11) in the support holder (6) receiving the bosses (17) are of L shape, whereof the vertical side opens out at the upper end of the support holder (6).

3. Control mechanism for a fire hydrant according to one of claims 1 or 2, wherein the vertical housing (13) receiving the lug (18) is in the form of a groove parallel to the vertical axis (X—X) of the fire hydrant and of a length such that it allows the rotation of the support member (7) about the horizontal axis (Y—Y).

4. Control mechanism for a fire hydrant according to claim 1, wherein the control rod (19) engaged with the central sleeve (14) prevents any movement of rotation of the support member (7) about the horizontal axis (Y—Y).

5. Control mechanism for a fire hydrant according to claim 1, wherein said support holder (6) is attached to the upper end of the lower elongated pipe, by screwing.

6. Control mechanism for a fire hydrant according to claim 5, wherein the support holder (6) terminates at its upper end in a flange (9) for connection to the outer body (1).

7. Control mechanism for a fire hydrant according to claim 6, wherein the support holder (6) retains said mechanism and connects the outer body (1) and the elongated pipe (2).

* * * * *